US009455553B2

(12) United States Patent
Shimamura et al.

(10) Patent No.: US 9,455,553 B2
(45) Date of Patent: Sep. 27, 2016

(54) SPARK PLUG

(71) Applicant: NGK SPARK PLUG CO., LTD., Nagoya-shi, Aichi (JP)

(72) Inventors: Takuya Shimamura, Iwakura (JP); Jiro Kyuno, Kiyosu (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/767,022

(22) PCT Filed: Feb. 12, 2014

(86) PCT No.: PCT/JP2014/000710

§ 371 (c)(1),
(2) Date: Aug. 11, 2015

(87) PCT Pub. No.: WO2014/125811

PCT Pub. Date: Aug. 21, 2014

(65) Prior Publication Data

US 2015/0372457 A1 Dec. 24, 2015

(30) Foreign Application Priority Data

Feb. 15, 2013 (JP) ..... 2013-027330

(51) Int. Cl.
*H01T 13/08* (2006.01)

(52) U.S. Cl.
CPC ..... *H01T 13/08* (2013.01)

(58) Field of Classification Search
CPC ..... H01T 13/08; H01T 13/20; H01T 13/12; H01T 13/00; H01T 13/02
See application file for complete search history.

(56) References Cited

U.S. PATENT DOCUMENTS

2014/0042894 A1 2/2014 Miyashita et al. ..... 313/144

FOREIGN PATENT DOCUMENTS

| | | | | |
|---|---|---|---|---|
| EP | 2733797 A1 | 5/2014 | ..... | H01T 13/08 |
| JP | H02-005648 U | 1/1990 | ..... | F16J 15/08 |
| JP | H06-283249 A | 10/1994 | ..... | H01T 13/08 |
| JP | 2006-236906 A | 9/2006 | ..... | H01T 13/20 |
| JP | 2013-020790 A | 1/2013 | ..... | H01T 13/08 |
| WO | WO 2012-147503 A1 | 11/2012 | ..... | H01T 13/08 |

OTHER PUBLICATIONS

Japanese Industrial Standard, JIS B8031, 2006, "Internal Combustion Engines—spark-plugs" (copy included in English).
International Standard ISO 22977, First Edition Jul. 15, 2005, "Road Vehicles—M12x1,25 spark-plugs with flat seating and 14 mm bi-hexagon and their cylinder head housing".
Search Report issued in corresponding International Application No. PCT/JP2014/000710, dated Apr. 15, 2014.
Japanese Industrial Standard, JIS Z 2244, 1992, Method of Vickers hardness test (copy included in English).

*Primary Examiner* — Kevin Quarterman
(74) *Attorney, Agent, or Firm* — Kusner & Jaffe

(57) ABSTRACT

A spark plug includes a metal shell formed with a mounting male thread portion and a radially outwardly protruding seat portion and a solid annular gasket disposed between the male thread portion and the seat portion. The gasket has a recessed portion formed with a depth in the direction of an axis such that the recessed portion has an opening at a front end surface of the gasket (18) located opposite to the seat portion. The front end surface of the gasket includes an inner peripheral front end surface region decreasing in thickness toward an inner periphery of the gasket and an outer peripheral front end surface region formed radially outside the inner peripheral front end surface region. The opening of the recessed portion is located radially inside an innermost periphery of the outer peripheral front end surface region.

7 Claims, 8 Drawing Sheets

SPARK PLUG

RELATED APPLICATIONS

This application is a National Stage of International Application No. PCT/JP2014/000710 filed Feb. 12, 2014, which claims the benefit of Japanese Patent Application No. 2013-027330 filed Feb. 15, 2013.

FIELD OF THE INVENTION

The present invention relates to a spark plug for use in an internal combustion engine or the like.

BACKGROUND OF THE INVENTION

A spark plug is mounted to e.g. an internal combustion engine (sometimes just referred to as "engine") and used to ignite an air-fuel mixture in a combustion chamber of the internal combustion engine. In general, the spark plug includes an insulator formed with an axial hole, a center electrode inserted in a front side of the axial hole, a metal shell arranged around an outer peripheral surface of the insulator and a ground electrode joined to a front end portion of the metal shell so as to define a discharge gap between the center electrode and the ground electrode. The metal shell has a seat portion protruding radially outwardly in a flanged shape and a male thread portion formed in front of the seat portion for mounting of the spark plug.

In some cases, a solid annular gasket is fitted around a thread neck of the metal shell between the seat portion and the male thread portion (see, for example, Japanese Laid-Open Patent Publication No. H06-283249). In a state that the spark plug is mounted to the internal combustion engine, a front end surface of the gasket located opposite to the seat portion is held in contact with the internal combustion engine (more specifically, engine head); and a rear end surface of the gasket facing the seat portion is held in contact with the seat portion. By this gasket, the air tightness of the combustion chamber can be secured.

Further, an inner peripheral portion of the gasket protrudes radially inwardly with the application of a load to an inner peripheral region of the front end surface of the gasket so that the gasket can be prevented from detachment from the metal shell. It is herein noted that a recessed portion is formed in the front end surface of the gasket with the application of such a load to the front end surface of the gasket.

In order to more assuredly prevent detachment of the solid annular gasket from the metal shell, it is desirable that the inner peripheral portion of the gasket protrudes radially inwardly by a large amount. It is thus conceivable to apply a greater load to the front end surface of the gasket for increase of the protrusion amount of the gasket. In this case, however, there is a possibility of waviness occurring on a portion of the front end surface of the gasket located adjacent to the opening of the recessed portion. The occurrence of waviness on the front end surface of the gasket results in inadequate contact between the gasket (front end surface) and the internal combustion engine in the state that the spark plug is mounted to the internal combustion engine. The air tightness of the combustion chamber may become insufficient due to inadequate contact between the gasket and the internal combustion engine. In other words, the air tightness of the combustion chamber and the detachment resistance of the gasket are in a trade-off relationship with each other. It has been difficult for the gasket to achieve both of good air tightness and high detachment resistance.

The present invention has been made in view of the above circumstances. An advantage of the present invention is a spark plug with a solid annular gasket such that, even in the case of applying a greater load for the formation of a recessed portion in the gasket, the gasket can ensure good air tightness and achieve both of air tightness and high detachment resistance.

SUMMARY OF THE INVENTION

The configurations suitable for achieving the above object of the present invention will be described below. The specific functions and effects of these configurations will be also described as needed.

Configuration 1.

In accordance with a first aspect of the present invention, there is provided a spark plug comprising:

a metal shell having an axial hole formed therethrough in the direction of an axis; and a solid annular gasket fitted around an outer peripheral surface of the metal shell, the metal shell including: a male thread portion formed on a front end region of the outer peripheral surface thereof for mounting of the spark plug; and a seat portion formed in rear of the male thread portion and protruding radially outwardly, the gasket being disposed between the male thread portion and the seat portion, wherein the gasket has a recessed portion formed with a depth in the direction of the axis such that the recessed portion has an opening at a surface of the gasket located opposite to the seat portion, wherein the gasket includes: an inner peripheral front end surface region formed such that a distance from a reference plane, which passes through a rear end of the recessed portion and extends perpendicular to a center line of the gasket, to the inner peripheral front end surface region decreases toward an inner periphery of the gasket; and an outer peripheral front end surface region formed radially outside the inner peripheral front end surface region, and wherein the opening of the recessed portion is located radially inside an innermost periphery of the outer peripheral front end surface region.

In configuration 1, the inner peripheral front end surface region is formed such that the distance from the reference plane to the inner peripheral front end surface region decreases toward the inner periphery of the gasket. In a state that the spark plug is mounted to an internal combustion engine, only the outer peripheral front end surface region is held in contact with the internal combustion engine (more specifically, engine head); and the inner peripheral front end surface region is kept separated from the internal combustion engine. Further, the opening of the recessed portion is located radially inside the innermost periphery of the outer peripheral front end surface region, i.e., located at the inner peripheral front end surface region. The inner peripheral front end surface region, on which waviness could occur due to the formation of the recessed portion, can be thus prevented from being in contact with the internal combustion engine. It is therefore possible to properly improve contact between the gasket and the internal combustion engine and ensure good air tightness.

In consideration of deterioration of air tightness by waviness, it has conventionally been difficult to increase the load for the formation of the recessed portion. In configuration 1, by contrast, good air tightness can be secured even in the occurrence of waviness. It is therefore possible to increase the load for the formation of the recessed portion, let an inner peripheral portion of the gasket protrude radially inwardly by a large amount and assuredly prevent detachment of the gasket from the metal shell.

In this way, the gasket is able to achieve both of good air tightness and high detachment resistance by the adoption of configuration 1.

Configuration 2.

In accordance with a second aspect of the present invention, there is provided a spark plug according to configuration 1, wherein, in a cross section including the center line and passing through the rear end of the recessed portion, the inner peripheral front end surface region has a first inner peripheral front end surface area located radially outside the opening of the recessed portion.

In configuration 2, at least part of the inner peripheral front end surface region (i.e. the first inner peripheral front end surface area) is present between the opening of the recessed portion and the outer peripheral front end surface region. It is thus possible to, even when waviness occurs due to the formation of the recessed portion, effectively prevent the waviness from reaching the outer peripheral front end surface region and allow more reliable improvement in air tightness.

Configuration 3.

In accordance with a third aspect of the present invention, there is provided a spark plug according to configuration 1 or 2, wherein the gasket satisfies a condition of $L1<L2$ where, in the cross section including the center line and passing through the rear end of the recessed portion, L1 is a minimum distance from the center line to a point of the gasket located in front of the reference plane and closest to the center line; and L2 is a minimum distance from the center line to a point of the gasket located in rear of the reference plane and closest to the center line.

In order to more assuredly prevent detachment of the gasket from the metal shell, it is desirable that the inner peripheral portion of the gasket protrudes radially inwardly by a large amount. The inner peripheral portion of the gasket protrudes radially inwardly by a large amount when the minimum distance L1 becomes smaller than the minimum distance L2 by increase of the load for the formation of the recessed portion. For satisfaction of $L1<L2$, however, it is necessary to increase the load applied for the formation of the recessed portion. The possibility of waviness increases with such increase in load as mentioned above.

In configuration 3, it is possible to more assuredly prevent detachment of the gasket by satisfaction of $L1<L2$. Although there is a higher possibility of waviness, it is possible by the adoption of configuration 1 etc. to ensure good air tightness even in the occurrence of waviness. In other words, the adoption of configuration 1 etc. is effective for the spark plug where the gasket satisfies the condition of $L1<L2$ to show high detachment resistance but faces the higher possibility of waviness.

Configuration 4.

According to a fourth aspect of the present invention, there is provided a spark plug according to any one of configurations 1 to 3, wherein the opening of the recessed portion is formed at a circumferential part of the surface of the gasket located opposite to the seat portion.

In configuration 4, it is possible to easily form the recessed portion and ensure good air tightness.

Configuration 5.

According to a fifth aspect of the present invention, there is provided a spark plug according to any one of configurations 1 to 4, wherein the gasket satisfies a condition of $0.2 \leq B/A \leq 0.75$ where A (mm) is an protrusion amount by which the seat portion protrudes radially outwardly relative to a minimum imaginary cylinder enclosing the male thread portion; and B (mm) is a length of the outer peripheral front end surface region in a direction perpendicular to the center line in the cross section including the center line.

The term "protrusion amount A" corresponds to a radial width of the gasket before the formation of the recessed portion or a radial width of any circumferential part of the gasket in which the recessed portion is not formed.

In configuration 5, the ratio B/A is set greater than or equal to 0.2. It is thus possible to secure the sufficient contact area of the outer peripheral front end surface region relative to the internal combustion engine for further improvement in air tightness.

On the other hand, the ratio B/A is set smaller than or equal to 0.75 in configuration 5. It means that the length B, which corresponds to a width of the outer peripheral front end surface region, does not become excessively large and, by extension, that the inner peripheral front end surface region attains a certain width. It is thus possible to, even when waviness occurs due to the formation of the recessed part, more assuredly prevent the waviness from reaching the outer peripheral front end surface region and improve contact between the outer peripheral front end surface region and the internal combustion engine for further improvement in air tightness.

Configuration 6.

According to a sixth aspect of the present invention, there is provided a spark plug according to any one of configurations 1 to 6, wherein a surface of the gasket facing the seat portion includes: an inner peripheral rear end surface region at least partially located in rear of the inner peripheral front end surface region; and an outer peripheral rear end surface region at least partially located in rear of the outer peripheral front end surface region; and wherein, in the cross section, a distance L3 from the reference plane to the inner peripheral rear end surface region along the center line is smaller than a distance L4 from the reference plane to the outer peripheral rear end surface region along the center line.

In configuration 6, only the outer peripheral rear end surface region among the surface of the gasket facing the seat portion is held in contact with the seat portion in the state that the spark plug is mounted to the internal combustion engine. It is thus possible to increase the contact pressure between the seat portion and the gasket (outer peripheral rear end surface region). As the outer peripheral front end surface region is located in front of the outer peripheral rear end surface region, the increased contact pressure is smoothly transmitted to the outer peripheral front end surface region. It is thus possible to increase the contact pressure between the outer peripheral front end surface region and the internal combustion engine. As a result, the air tightness can be improved very effectively.

Configuration 7.

According to a seventh aspect of the present invention, there is provided a spark plug according to any one of configurations 1 to 6, wherein the gasket has a hardness of 100 to 200 Hv in units of Vickers hardness.

The hardness of the gasket refers to a value measured at any part, other than the part in which there occurs a change in hardness due to the formation of the recessed portion, of the surface of the gasket (e.g. measured at the outer peripheral front end surface region or the outer peripheral rear end surface region).

In configuration 7, the hardness of the gasket is set higher than or equal to 100 Hv so as to effectively protect the gasket from thermal deformation even when the gasket reaches a high temperature during operation of the internal combustion engine. It is thus possible to more assuredly prevent loosening of the spark plug relative to the internal combustion engine and maintain good air tightness over a long period of time.

On the other hand, the hardness of the gasket is set lower than or equal to 200 Hv so as to not only allow easy formation of the recessed portion but also allow the inner peripheral portion of the gasket to protrude sufficiently radially inwardly. It is thus possible to more assuredly prevent detachment of the gasket.

Configuration 8.

According to an eighth aspect of the present invention, there is provided a spark plug according to any one of claims 1 to 7, wherein, in a cross section including the axis of the metal shell, an acute angle between a surface of the seat portion facing the gasket and an imaginary line perpendicular to the axis of the metal shell is 0.5 to 0.6°.

In configuration 8, the acute angle (sometimes referred to as "seat surface angle") between the surface of the seat portion facing the gasket (referred to as "seat surface") and the imaginary line perpendicular to the axis of the metal shell is set to within the range of 0.5 to 0.6°. Namely, the angle of the seat surface relative to the direction perpendicular to the axis of the metal shell is set to within the range of 0.5 to 0.6°.

Even when the seat surface is angled as mentioned above, it is possible by the adoption of configurations 1 to 7 to ensure good air tightness.

DETAILED DESCRIPTION OF THE PREFERRED EMBODIMENTS

Hereinafter, one exemplary embodiment of the present invention will be described below with reference to the drawings.

Figure 1:
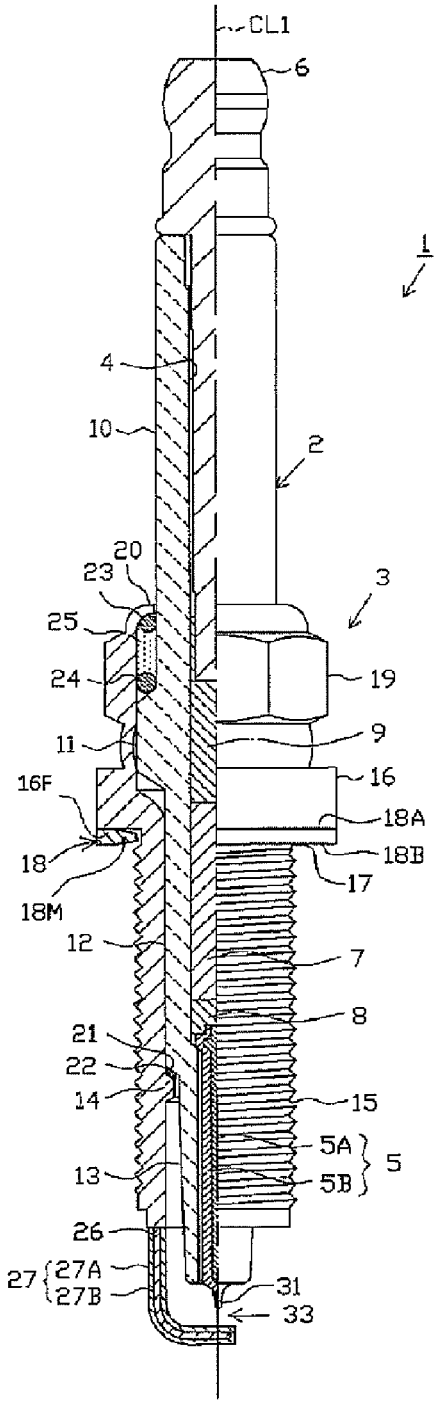
FIG. 1 is an elevation view, partially in section, of a spark plug according to one embodiment of the present invention.

FIG. 1 is an elevation view, partially in section, of a spark plug 1 according to one exemplary embodiment of the present invention. It is herein noted that the direction of an axis CL1 of the spark plug 1 corresponds to the vertical direction of FIG. 1 where the front and rear sides of the spark plug 1 are shown on the bottom and top sides of FIG. 1, respectively.

The spark plug 1 includes a cylindrical ceramic insulator 2 and a cylindrical metal cell 3 holding therein the ceramic insulator 2.

The ceramic insulator 2 is made of sintered alumina as is generally known and has an outer shape including a rear body portion 10 located on a rear side thereof, a large-diameter portion 11 located in front of the rear body portion 10 and protruding radially outwardly, a middle body portion 12 located in front of the large-diameter portion 11 and made smaller in diameter than the large-diameter portion 11 and a leg portion 13 located in front of the middle body portion 12 and made smaller in diameter than the middle body portion 12. The large-diameter portion 11, the middle body portion 12 and major part of the leg portion 13 of the ceramic insulator 2 are accommodated in the metal shell 3. The ceramic insulator 2 also has a step portion 14 located between the middle body portion 12 and the leg portion 13 and tapered down toward the front such that the ceramic insulator 2 can be retained in the metal shell 3 by means of the step portion 14.

Further, an axial hole 4 is formed through the ceramic insulator 2 in the direction of the axis CL1. A center electrode 5 is inserted and fixed in a front side of the axial hole 4. In the present embodiment, the center electrode 5 has an inner layer 5A made of a highly thermal-conductive metal material (such as copper, copper alloy or pure nickel (Ni)) and an outer layer 5B made of a Ni-based alloy. The center electrode 5 is formed as a whole into a rod shape (cylindrical column shape) and held in the ceramic insulator 2 with a front end portion of the center electrode 5 protruding from a front end of the ceramic insulator 2. A tip of highly wear-resistant metal material (such as iridium alloy or platinum alloy) is joined to the front end portion of the center electrode 5.

A terminal electrode 6 is inserted and fixed in a rear side of the axial hole 4 with a rear end portion of the terminal electrode 6 protruding from a rear end of the ceramic insulator 2. [0039.] A cylindrical column-shaped resistive element 7 is disposed between the center electrode 5 and the terminal electrode 6 within the axial hole 4 and is electrically connected at opposite ends thereof to the center electrode 5 and the terminal electrode 6 through conductive glass seal layers 8 and 9, respectively.

The metal shell 3 is made of a metal material such as low carbon steel and has a cylindrical shape in the direction of the axis CL1. The metal shell 3 includes, on a front end side of an outer peripheral surface thereof, a male thread portion 15 adapted for mounting the spark plug 1 into a mounting hole of a combustion apparatus (such as an internal combustion engine or a fuel cell processing device). The metal shell 3 also includes a seat portion 16 located in rear of the male thread portion 15 and protruding radially outwardly in a flanged shape. There is a cylindrical thread neck 17 formed between the male thread portion 15 and the seat portion 16. The seat portion 16 has a seat surface 16F adjacent to and facing a gasket 18. In the present embodiment, the seat surface 16F is substantially perpendicular to an axis of the metal shell. The gasket 18 is made of a predetermined metal material (such as copper- or iron-based metal material) in a solid annular shape and disposed around the thread neck 17. (The gasket 18 will be explained later in more detail.) The metal shell 3 further includes, on a rear end side thereof, a tool engagement portion 19 formed into a hexagonal cross-sectional shape for engagement with a tool such as wrench for mounting the spark plug 1 to the combustion apparatus and a crimped portion 20 bent radially inwardly in rear of the tool engagement portion 19.

Furthermore, the metal shell 3 has a tapered step portion 21 formed on an inner peripheral surface thereof so as to hold thereon the ceramic insulator 2. The ceramic insulator 2 is inserted in the metal shell 3 from the rear to the front, and then, fixed in the metal shell 3 by crimping an open rear end portion of the metal shell 3 radially inwardly and thereby forming the crimped portion 20 while holding the step portion 14 of the ceramic insulator 2 on the step portion 21 of the metal shell 3. An annular plate packing 22 is disposed between the step portions 14 and 21 so as to maintain the air tightness of the combustion chamber and prevent the leakage of fuel gas to the outside through between the inner peripheral surface of the metal shell 3 and the leg portion 13 of the ceramic insulator 2 exposed to the combustion chamber of the combustion apparatus.

In order to secure more complete seal by crimping, annular ring members 23 and 24 are disposed between the metal shell 3 and the ceramic insulator 2 within the rear end portion of the metal shell 3; and the space between the ring members 23 and 34 is filled with a powder of talc 25. The metal shell 3 thus holds therein the ceramic insulator 2 via the plate packing 22, the ring members 23 and 24 and the talc 25.

A ground electrode 27 is joined at one end portion thereof to a front end portion 26 of the metal shell 3 and is bent at a substantially middle portion thereof such that a side surface of a distal end portion of the ground electrode 27 faces the front end portion (tip 31) of the center electrode 5. In the present embodiment, the ground electrode 27 has an outer layer 27A made of a Ni-based alloy and an inner layer 27B made of a highly thermal-conductive metal material (such as copper, copper alloy or pure nickel (Ni)). There is a discharge gap 33 defined between the front end face of the center electrode 5 (tip 31) and the distal end portion (other end portion) of the ground electrode 27. In this discharge gap 33, a spark discharge is generated substantially along the direction of the axis CL1.

Next, the structure of the gasket 18 as the characteristic feature of the present invention will be explained below.

Figure 2:
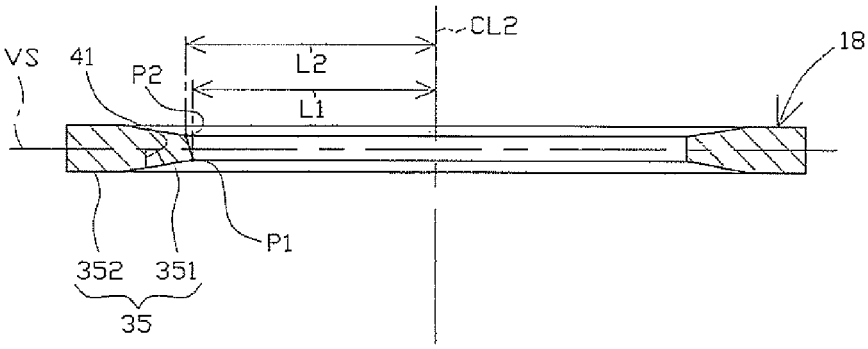
FIG. 2 is a section view of a gasket of the spark plug.
Figure 3:
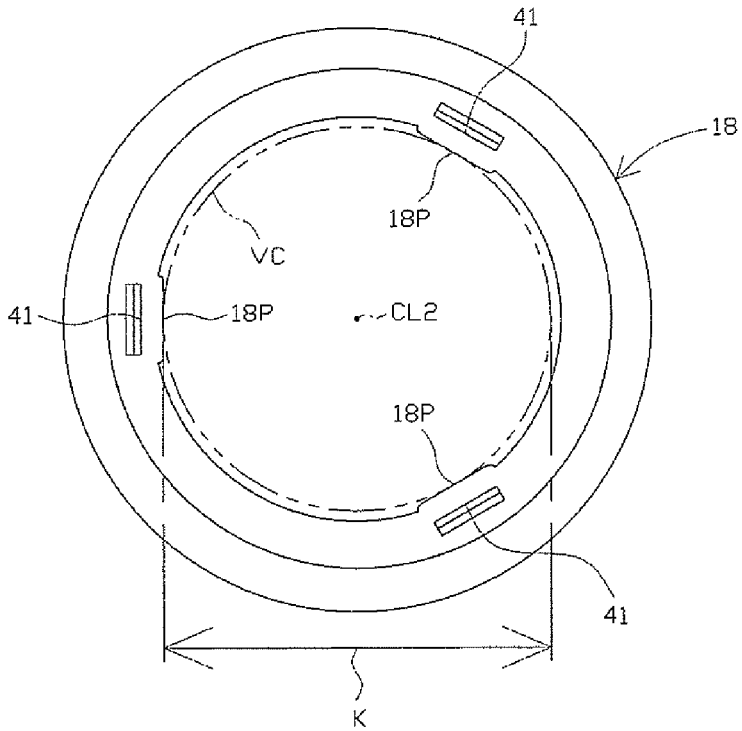
FIG. 3 is a bottom view showing the formation position of a recessed portion in the gasket.

Referring to FIG. 2, the gasket 18 have recesses 41 formed with a depth in the direction of the axis CL1 such that each of the recesses 41 has an opening at a front end surface 35 of the gasket 18 located opposite to the seat portion 16. In particular, a plurality of recesses 41 are formed intermittently in the circumferential direction as shown in FIG. 3 in the present embodiment. By the formation of such recesses 41, parts of the gasket 18 located radially inside the recesses 41 are deformed so as to protrude radially inwardly. As a consequence, a plurality of protrusions 18P are formed on the gasket 18 intermittently in the circumferential direction as shown in FIG. 3. An inside diameter K of the gasket 18 (i.e. a diameter of an imaginary circle VC tangent to the respective protrusions 18P) is then set smaller than a thread diameter of the male thread portion 15.

Figure 4:
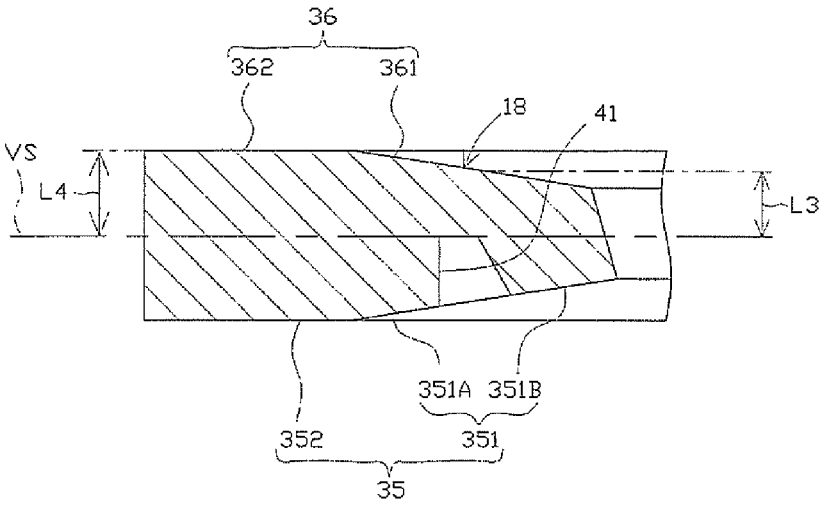
FIG. 4 is an enlarged section view of part of the gasket.

Referring back to FIG. 2, the front end surface 35 includes an inner peripheral front end surface region 351 located on a radially inner side thereof and an outer peripheral front end surface region 352 located radially outside and adjacent to the inner peripheral front end surface region 351. As shown in FIG. 4, a plane passing through rear ends of the recesses 41 and extending perpendicular to a center line CL2 of the gasket 18 (also see FIG. 2) is assumed as a reference plane VS. In the present embodiment, the inner peripheral front end surface region 351 is formed such that a distance from the reference plane VS to the inner peripheral front end surface region 351 along the center line CL2 gradually decreases toward the inner periphery of the gasket. On the other hand, the outer peripheral front end surface region 352 is formed such that a distance from the reference plane VS to the outer peripheral front end surface region 352 along the center line CL2 is substantially constant in the radial direction.

In a cross section including the center line CL2 and passing through the rear ends of the recesses 41, the inner peripheral front end surface region 351 has a first inner peripheral front end surface area 351A located radially outside the openings of the recesses 41 and a second inner peripheral front end surface area 351B located radially inside the openings of the recesses 41.

Figure 5:
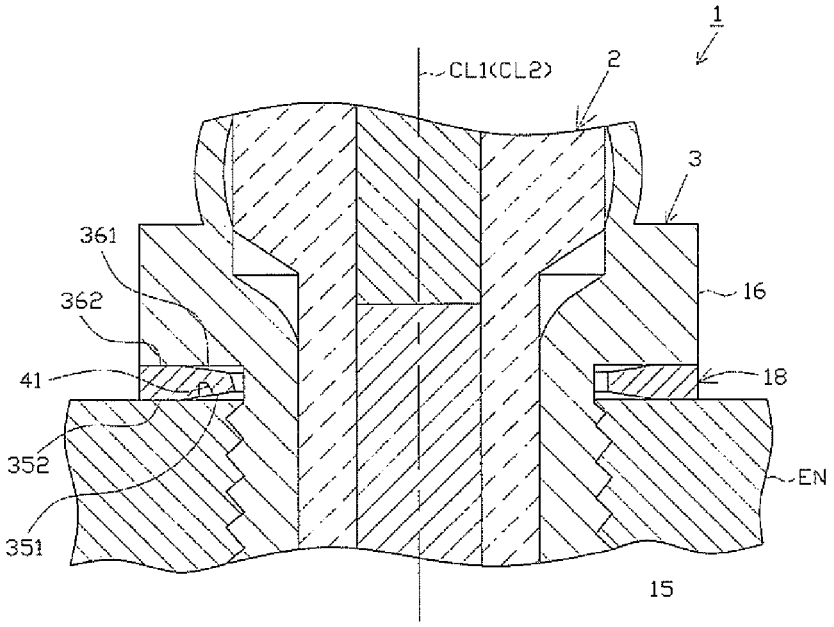
FIG. 5 is an enlarged section view showing a state where the spark plug is mounted to an engine head.

The openings of the recesses 41 are located radially inside the innermost periphery of the outer peripheral front end surface region 352. Accordingly, a part of the inner peripheral front end surface region 351 (i.e. the inner peripheral front end surface area 351A) is present between the openings of the recesses 41 and the outer peripheral front end surface region 352. The gasket 18 is thus so configured that, in a state that the spark plug 1 is mounted to an engine head EN of the internal combustion engine, only the outer peripheral front end surface region 352 is held contact with the engine head EN; and the inner peripheral front end surface region 351, which is located adjacent to the openings of the recesses 41, is kept separated from the engine head EN as shown in FIG. 5.

The gasket 18 is also configured to, in the cross section including the center line CL2 and passing through the rear ends of the recesses 41, satisfy the condition of L1<L2 where L1 the minimum distance from the center line CL2 to a point P1 of the gasket 18 located in front of the reference plane VS and closest to the center line CL2; and L2 is the minimum distance from the center line CL2 to a point P2 of the gasket 18 located in rear of the reference plane VS and closest to the center line CL2 as shown in FIG. 2.

Furthermore, a rear end surface 36 of the gasket 18 facing the seat portion 16 includes an inner peripheral rear end surface region 361 at least partially located in rear of (in the present embodiment, entirely located in rear of) the inner peripheral front end surface region 351 and an outer peripheral rear end surface region 362 at least partially located in rear of (in the present embodiment, entirely located rear of) the outer peripheral front end surface region 352 as shown in FIG. 4. In the above cross section, a distance L3 from the reference plane VS to the inner peripheral rear end surface region 361 along the center line CL2 is set smaller than a distance L4 from the reference plane VS to the outer peripheral rear end surface region 362 along the center line CL2. The gasket 18 is thus so configured that, in the state that the spark plug 1 is mounted to the engine head EN of the internal combustion engine, only the outer peripheral front end surface region 362 is held in contact with the seat portion 16 (seat surface 16F); and the inner peripheral front end surface region 361 is kept separated from the seat portion 16 as shown in FIG. 5.

Figure 6:
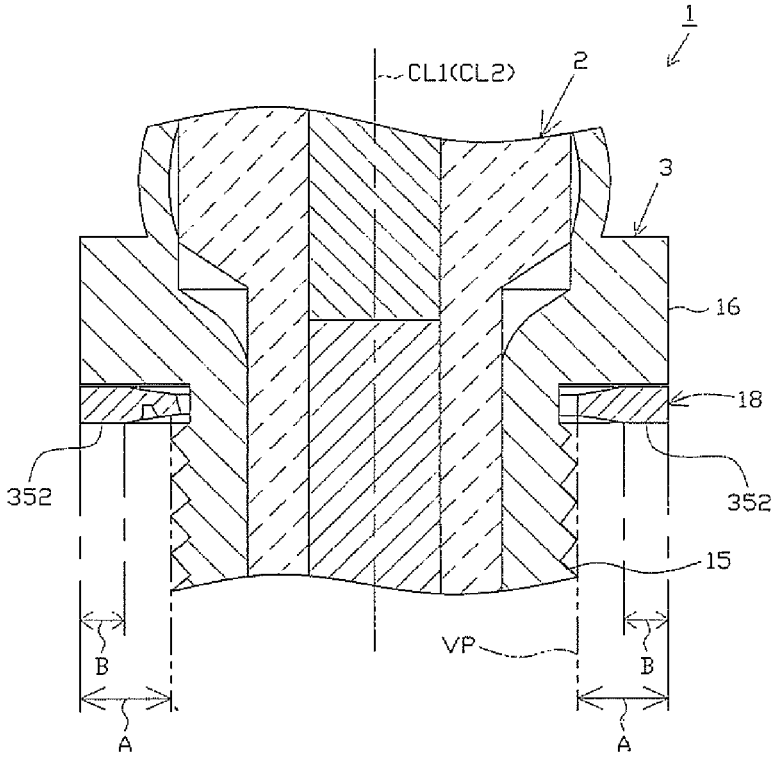
FIG. 6 is an enlarged section view showing a protrusion amount A and a length B of the gasket.

The gasket 18 is further configured to satisfy the condition of $0.2 \leq B/A \leq 0.75$ where A (mm) is the protrusion amount by which the seat portion 16 protrudes radially outwardly relative to a minimum imaginary cylinder enclosing the male thread portion 15; and B (mm) is the length of the outer peripheral front end surface region 352 in a direction perpendicular to the center line CL2 in the cross section including the center line CL2 as shown in FIG. 6. The term "protrusion amount A" corresponds to a radial width of the gasket 18 before the formation of the recesses or a radial width of any circumferential part of the gasket 18 in which the recesses are not formed.

Moreover, the gasket 18 has a hardness of 100 to 200 Hv in terms of Vickers hardness in the present embodiment. The term "hardness" of the gasket 18 refers to a value measured at any part, other than the part in which there occurs a change in hardness due to the formation of the recesses 41, of the surface of the gasket 18 (e.g. measured at the outer peripheral front end surface region 352 or the outer peripheral rear end surface region 362). The hardness of the gasket 18 can be determined according to e.g. JIS Z 2244 and, more specifically, based on the length of a diagonal line of indentation formed in the gasket 18 by pressing a square-based pyramidal diamond indenter against the surface of the gasket 18 with a given load (e.g. 980.7 mN).

As described above, the gasket 18 is so configured that, in a state that the spark plug 1 is mounted to the engine head EN of the internal combustion engine, only the outer peripheral front end surface region 352 is held contact with the engine head EN; and the inner peripheral front end surface region 351, which is located adjacent to the openings of the recesses 41, is kept separated from the engine head EN. The openings of the recesses 41 are located radially inside the innermost periphery of the outer peripheral front end surface region 352, i.e., located at the inner peripheral front end surface region 351. Thus, the inner peripheral front end surface region 3 51, on which waviness could occur due to the formation of the recesses 431, can be prevented from being in contact with the engine head EN. It is therefore possible to properly improve contact between the gasket 18 and the engine head EN and ensure good air tightness.

As good air tightness can be secured even in the occurrence of waviness, it is possible to increase the load for the formation of the recesses 41, let the inner peripheral portion of the gasket 18 protrude radially inwardly by a large amount and assuredly prevent detachment of the gasket 18 from the metal shell 3.

In this way, the gasket 18 is able to achieve both of good air tightness and high detachment resistance in the present embodiment.

Further, the first inner peripheral front end surface area 351A is present between the openings of the recesses 41 and the outer peripheral front end surface region 352. It is thus possible to, even when waviness occurs due to the formation of the recesses 41, effectively prevent the waviness from reaching the outer peripheral front end surface region 352 and allow more reliable improvement in air tightness.

The gasket 18 is also configured to satisfy the condition of $L1 < L2$ such that the inner peripheral portion of the gasket 18 protrudes more radially inwardly on the front side than on the rear side. It is thus possible to more assuredly prevent detachment of the gasket 18 from the metal shell 3.

In addition, the recesses 41 are formed intermittently in a circumferential part of the front end surface 35. It is thus possible to easily form the recesses 41 and ensure good air tightness.

Furthermore, the ratio B/A is set greater than or equal to 0.2. It is thus possible to secure the sufficient contact area of the outer peripheral front end surface region 352 relative to the engine head EN for further improvement in air tightness.

On the other hand, the ratio B/A is set smaller than or equal to 0.75. It means that the length B does not become excessively large and, by extension, that the inner peripheral front end surface region 351 attains a certain width in the radial direction. It is thus possible to, even when waviness occurs due to the formation of the recesses 41, more assuredly prevent the waviness from reaching the outer peripheral front end surface region 352 and improve contact between the outer peripheral front end surface region 352 and the engine head EN for further improvement in air tightness.

The gasket 18 is further configured to satisfy the condition of $L3 < L4$ such that only the outer peripheral rear end surface region 362 is held in contact with the seat portion 16 in the state that the spark plug 1 is mounted to the engine head EN of the internal combustion engine. It is thus possible to increase the contact pressure between the seat portion 16 and the gasket 18 (outer peripheral rear end surface region 362). As the outer peripheral front end surface region 352 is located in front of the outer peripheral rear end surface region 362, the increased contact pressure is smoothly transmitted to the outer peripheral front end surface region 352. It is thus possible to increase the contact pressure between the outer peripheral front end surface region 352 and the engine head EN. As a result, the air tightness can be improved very effectively.

Moreover, the hardness of the gasket 18 is set higher than or equal to 100 Hv so as to effectively protect the gasket 18 from thermal deformation even when the gasket 18 reaches a high temperature. It is thus possible to more assuredly prevent loosening of the spark plug 1 relative to the internal combustion engine and maintain good air tightness over a long period of time.

On the other hand, the hardness of the gasket 18 is set lower than or equal to 200 Hv so as to not only allow easy formation of the recesses 41 but also allow the inner peripheral portion of the gasket 18 to protrude sufficiently radially inwardly. It is thus possible to more assuredly prevent detachment of the gasket 18.

The following tests were conducted in order to verify the effects of the above embodiment.

Spark plug samples of the above embodiment and spark plug samples of comparative example, ten samples for each type, were prepared. Each of the samples was subjected to air tightness test according to JIS B 8031. The procedure of the air tightness test was as follows. Each of the samples was mounted to an aluminum bushing, as a test stage simulating an engine head of an internal combustion engine, with a fastening torque of 25 N·m. A front end portion of the sample was heated to and maintained at 150° C. for 30 minutes. Then, the amount of air leakage per minute between the gasket and the metal shell and between the gasket and the aluminum bushing was measured by applying an air pressure of 1.5 MPa to the front end portion of the sample. It can be said that the sample had good air tightness when the leakage amount of the sample was 5 ml/min or less.

In the respective embodiment samples, the recesses were located radially inside the innermost periphery of the outer peripheral front end surface region; and the inner peripheral front end surface region was formed in an inclined shape. Thus, the respective embodiment samples were so configured that only the outer peripheral front end surface region was held in contact with the aluminum bushing (internal combustion engine) in a state that the sample was mounted to the aluminum bushing (internal combustion engine). In the respective comparative example samples, the front end surface of the gasket was aligned in the direction perpendicular to the center line of the gasket. The respective comparative example samples were thus so configured that both of the inner peripheral front end surface region and the outer peripheral front end surface region were held in contact with the aluminum bushing (internal combustion engine) in a state that the sample was mounted to the aluminum bushing (internal combustion engine). In each of these samples, the recesses were formed in the inner peripheral of the front end surface of the gasket; and the male thread portion was formed with a thread diameter of M12.

Figure 7:
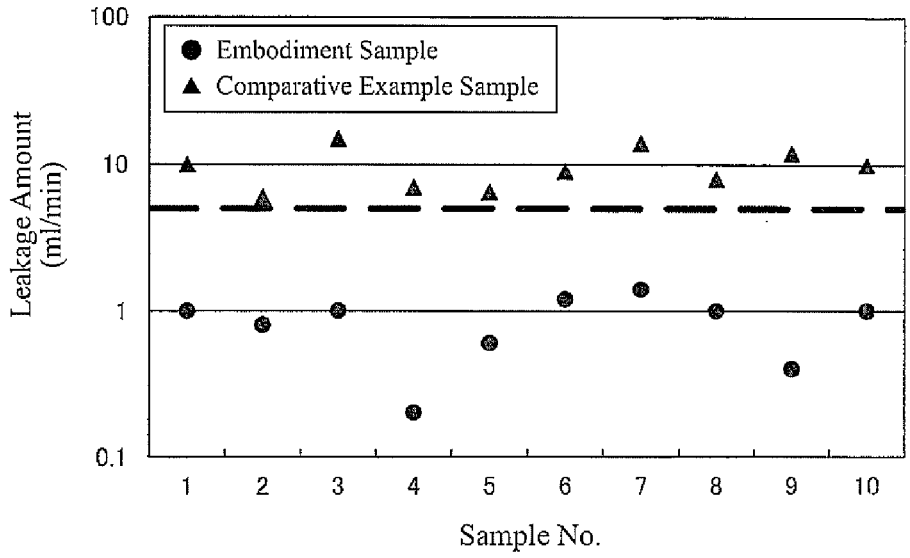
FIG. 7 is a graph showing air tightness test results of plug samples according to Examples and Comparative Examples.

FIG. 7 shows the air tightness test results. In FIG. 7, the test results of the embodiment samples are indicated by circles; and the test results of the comparative example samples are indicated by triangles. Further, the evaluation standard level of 5 ml/min is indicated by a horizontal dashed line in FIG. 7. (The same applies to FIGS. 8 and 9.)

As shown in FIG. 7, the embodiment samples in which only the outer peripheral front end surface region was held in contact with the aluminum bushing (internal combustion engine) had a leakage amount of less than 5 ml/min. It is apparent that these embodiment samples had good air tightness. The reason for this is assumed that it was possible to improve contact of the gasket with the internal combustion engine (aluminum bushing) as the inner peripheral front end surface region, on which waviness could occur due to the formation of the recesses, was separated from the internal combustion engine (aluminum bushing).

It has been shown by the above test results that, for improvement in air tightness, it is preferable that: the gasket has an inner peripheral front end surface region formed such that the distance from the reference plane to the inner peripheral front end surface region decreases toward the inner periphery of the gasket and an outer peripheral front end surface region formed radially outside the inner peripheral front end surface region; and the opening of the recessed portion was located radially inside the innermost periphery of the outer peripheral front end surface region.

Next, spark plug samples X, Y and Z of varying ratio B/A were prepared. Each of the samples was subjected to air tightness test in the same manner as above, except that the fastening torque was set to 20 N·m (that is, the air tightness test was conducted under a condition that air leakage was more likely to occur). It can be said that the sample had better air tightness when the leakage amount of the sample was 5 ml/min or less. Herein, the value A was a measurement value of the width of any part of the gasket in which the recesses were not formed in the direction perpendicular to the center line of the gasket, which was equivalent to the protrusion amount by which the seat portion protruded radially outwardly relative to the imaginary cylinder; and the value B was measured with the use of a pressure measurement film (e.g. "PRESCALE (registered trademark").

Figure 8:
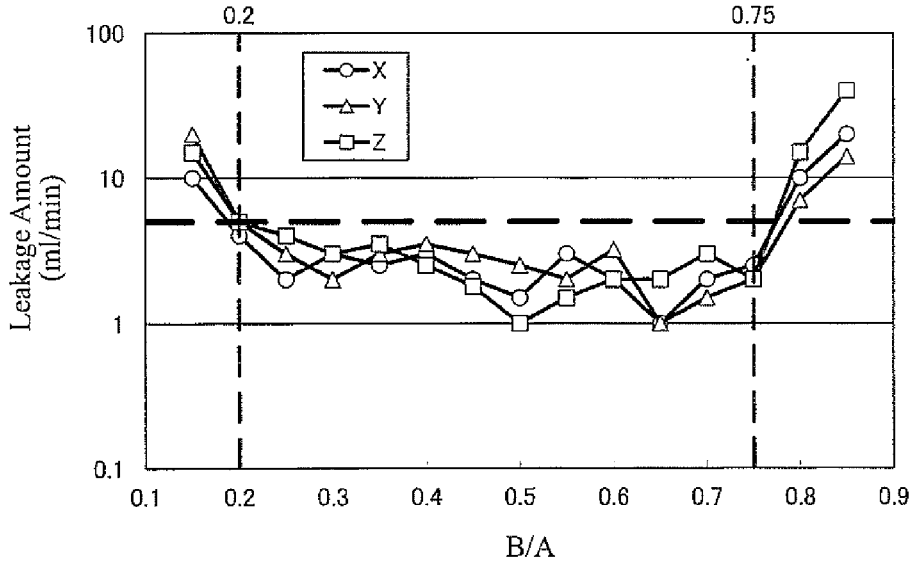
FIG. 8 is a graph showing air tightness test results of plug samples of varying ratio B/A.

FIG. 8 shows the air tightness test results. In FIG. 8, the test results of the samples X are indicated by circles; the test results of the samples Y are indicated by triangles; and the test results of the samples Z are indicated by squares. In the respective samples X, Y and Z, the metal shell and other components were the same in structure.

As shown in FIG. 8, the samples had better air tightness by satisfaction of $0.2 \leq B/A \leq 0.75$. The reason for this is assumed that: it was possible to secure the sufficient contact area of the outer peripheral front end surface region relative to the internal combustion engine (aluminum bushing) by setting the ratio B/A greater than or equal to 0.2; and it was possible to attain the certain width of the inner peripheral front end surface region and, even when waviness occurs due to the formation of the recessed portion, more assuredly prevent the waviness from reaching the outer peripheral front end surface region by setting the ratio B/A smaller than or equal to 0.75.

It has been shown by the above test results that it is more preferable to satisfy the condition of $0.2 \leq B/A \leq 0.75$ for further improvement in air tightness.

Next, spark plug samples of L3<L4 or L3=L4, ten samples for each type, were prepared. In the respective samples, the inner peripheral rear end surface region was formed in an inclined shape. Each of the samples was subjected to air tightness test in the same manner as above, except that the fastening torque was set to 15 N·m (that is, the air tightness test was conducted under a condition that air leakage was much more likely to occur). It can be said that the sample had much better air tightness when the leakage amount of the sample was 5 ml/min or less.

Figure 9:
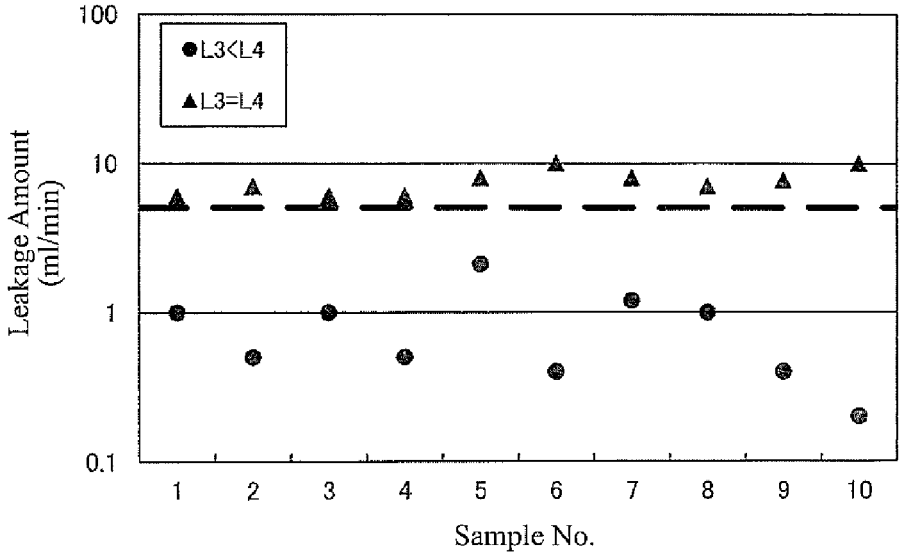
FIG. 9 is a graph showing air tightness test results of plug samples of varying magnitude relation between L3 and L4.

FIG. 9 shows the air tightness test results. In FIG. 8, the test results of the samples of L3<L4 are indicated by circles; and the test results of the samples of L3=L4 are indicated by triangles.

As shown in FIG. 9, the samples had much better air tightness by satisfaction of L3<L4. The reason for this is assumed that it was possible to increase the contact pressure between the seat portion and the gasket as only the outer peripheral rear end surface region of the gasket was held in contact with the seat portion; and, as the outer peripheral front end surface region was located in front of the outer peripheral rear end surface region, it was possible to smoothly transmit the increased contact pressure to the outer peripheral front end surface region and thereby increase the contact pressure between the gasket (outer peripheral front end surface region) and the internal combustion engine (aluminum bushing).

It has been shown by the above test results that it is more preferable to form the rear end surface of the gasket in such a manner as to satisfy the condition of L3<L4 for further improvement in air tightness.

Figure 10:
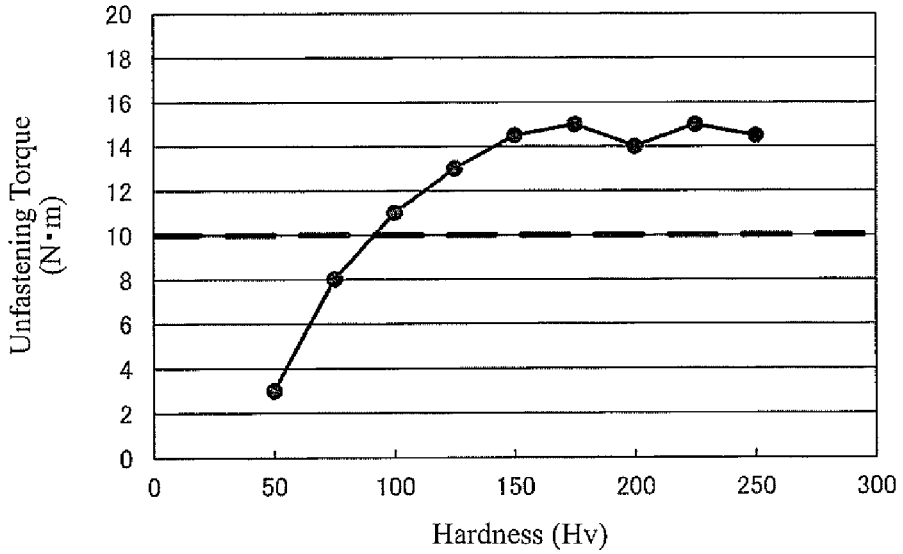
FIG. 10 is a graph showing loosening resistance test results of plug samples of varying gasket hardness.

Next, spark plug samples of varying gasket hardness (Hv) were prepared by changing the material and heat treatment conditions of the gasket. Each of the samples was subjected to loosening resistance test. The procedure of the loosening resistance test was as follows. Each of the samples was mounted to an aluminum bushing with a fastening torque of 20 N·m. Vibrations were applied to the sample for 8 hours in each of horizontal and vertical directions (total 16 hours) in the atmosphere of 50 to 200° C. with reference to the vibration test prescribed in ISO 11565, p. 3.4.4. Then, the unfastening torque Te (N·m) for removal of the sample from the aluminum bushing was measured. It can be said that the sample had resistance to loosening by heating and maintained good air tightness over a long period of time when the unfastening torque of the sample was 10 N·m or greater. FIG. 10 shows the loosening test results.

As shown in FIG. 10, the samples in which the hardness of the gasket was 100 Hv or higher had an unfastening torque of 10 N·m or greater. It is apparent that these samples maintained good air tightness over a long period of time. The reason for this is assumed that it was possible to effectively prevent thermal deformation of the gasket.

It has been shown by the above test results that it is preferable to set the hardness of the gasket to be 100 Hv or higher in order to prevent loosening of the spark plug relative to the internal combustion engine and maintain good air tightness over a long period of time.

Figure 11:
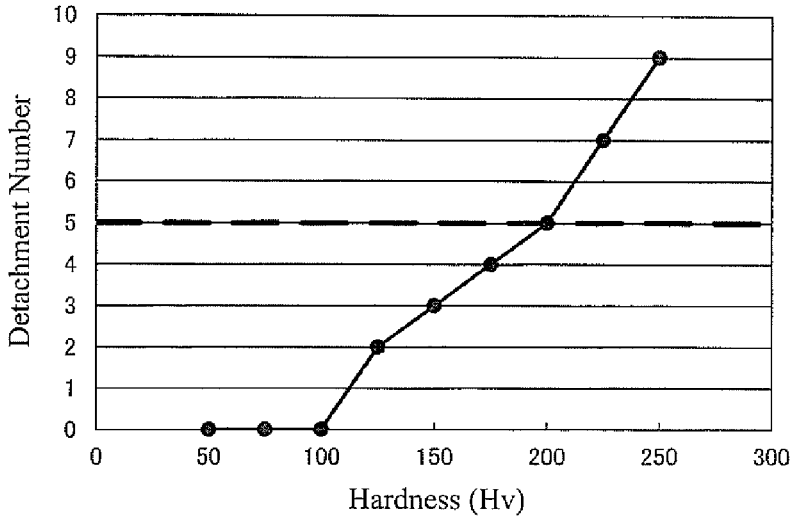
FIG. 11 is a graph showing gasket detachment resistance test results of plug samples of varying gasket hardness.

Additional spark plug samples of varying gasket hardness, ten samples for each type, were prepared by changing the material and heat treatment conditions of the gasket. Each of the samples was subjected to detachment resistance test. The procedure of the detachment resistance test was as follows. The gasket was rotated by hand relative to the metal shell and checked whether the gasket was detached from the metal shell. It can be said that the gasket was effectively prevented from detachment from the metal shell when the number of the samples in which detachment of the gasket occurred (referred to as "detachment number") was 5 out of 10. FIG. 11 shows the gasket detachment resistance test results.

As shown in FIG. 11, the samples in which the hardness of the gasket was 200 Hv or lower had a detachment number of 5 or less. It is apparent that these samples were effective in preventing detachment of the gasket from the metal shell. The reason for this is assumed that, as the gasket was easy to plastic-deform, it was possible to let the inner peripheral portion of the gasket protrude sufficiently radially inwardly by the formation of the recessed portion.

It has been shown by the above test results that it is preferable to set the hardness of the gasket to be 200 Hv or lower in order to more assuredly prevent detachment of the gasket.

Although the present invention has been described above with reference to the specific exemplary embodiment, the present invention is not limited to the above specific exemplary embodiment. For example, the present invention can alternatively be embodied as mentioned below. It is needless to say that any application examples modifications other than the following examples are possible.

Figure 12:
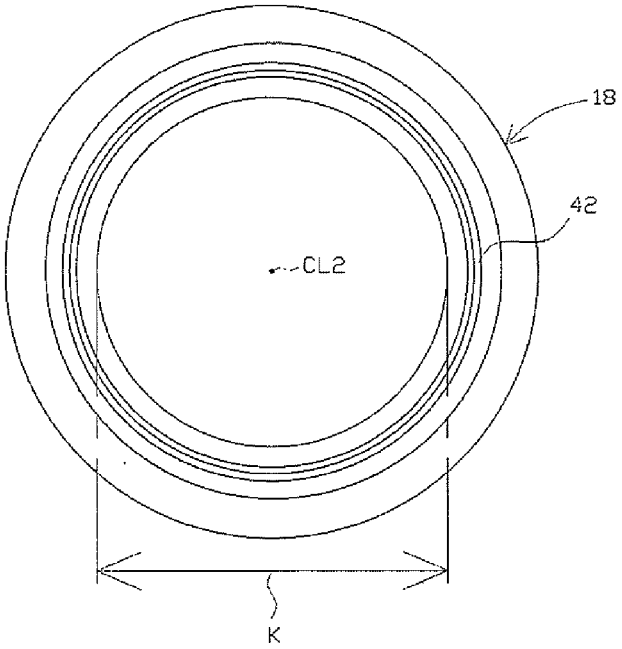
FIG. 12 is a bottom view showing the formation position of a recessed portion in a gasket of a spark plug according to another embodiment of the present invention.

(a) In the above embodiment, the recesses 41 are formed intermittently in the circumferential direction of the gasket 18. It is alternatively feasible to form an annular recess 42 in the circumferential direction of the gasket 18 as shown in FIG. 12. In this case, the entire periphery of the inner peripheral portion of the gasket 18 protrudes radially inwardly. The inside diameter K of the gasket 18 is consequently set smaller than the thread diameter of the male thread portion 15.

Figure 13:
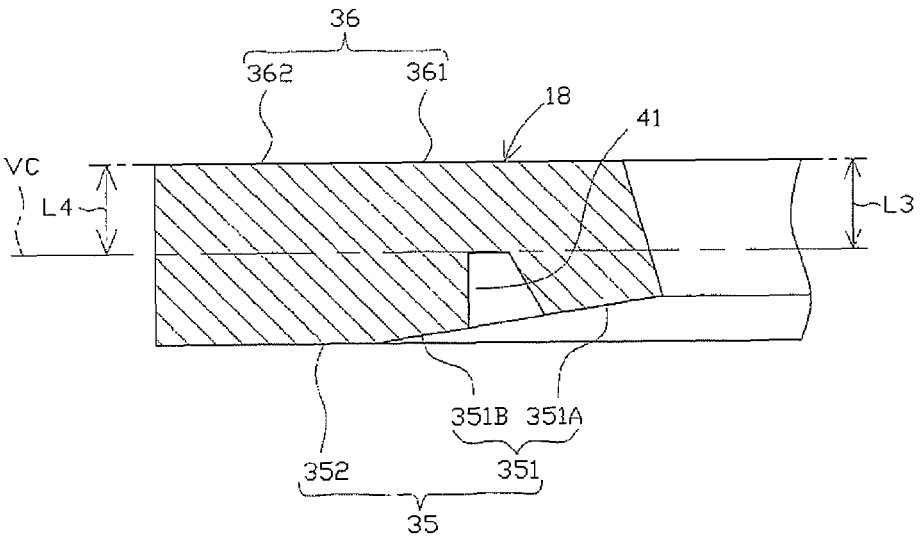
FIG. 13 is an enlarged section view of part of a gasket of a spark plug according to still another embodiment of the present invention.

(b) The distance L3 may alternatively be set equal to the distance L4 as shown in FIG. 13 although the distance L3 is set smaller than the distance L4 in the above embodiment.

(c) Although the boundary between the outer peripheral surface and the outer peripheral front end surface region 352 of the gasket 18 is angular in shape in the above embodiment, the part from the outer peripheral surface and the outer peripheral front end surface region 352 of the gasket 18 may alternatively be formed in an outwardly convex curved shape.

(d) In the above embodiment, the ground electrode 27 is joined to the front end portion 26 of the metal shell 3. Alternatively, the ground electrode may be formed by cutting a part of the metal shell (or a part of a front-end metal member previously joined to the metal shell) (see, for example, Japanese Laid-Open Patent Publication No. 2006-236906).

(e) Although the tool engagement portion 19 is hexagonal in cross section in the above embodiment, the shape of the tool engagement portion 19 is not limited to such a hexagonal cross-sectional shape. The tool engagement portion 19 may alternatively be formed into a Bi-HEX shape (modified dodecagonal shape) (according to ISO 22977: 2005(E)) or the like.

(f) In the above embodiment, the seat surface 16F is substantially perpendicular to the axis CL1 of the metal shell 3. The angle of the seat surface 16 relative to the direction perpendicular to the axis CL1 of the metal shell 3 is not limited to such angle. For example, an acute angle (referred to as "seat surface angle") between a surface of the seat portion 16 facing the gasket 18 (i.e. seat surface 16F) and an imaginary line perpendicular to the axis CL1 of the metal shell 3 may be set to 0.5 to 0.6°. Namely, the angle of the seat surface 16 relative to the direction perpendicular to the axis CL1 of the metal shell 3 may be set to 0.5 to 0.6°.

Even when the seat surface is angled as mentioned above, it is possible to ensure good air tightness by the use of the gasket according to the present invention.

Figure 14:
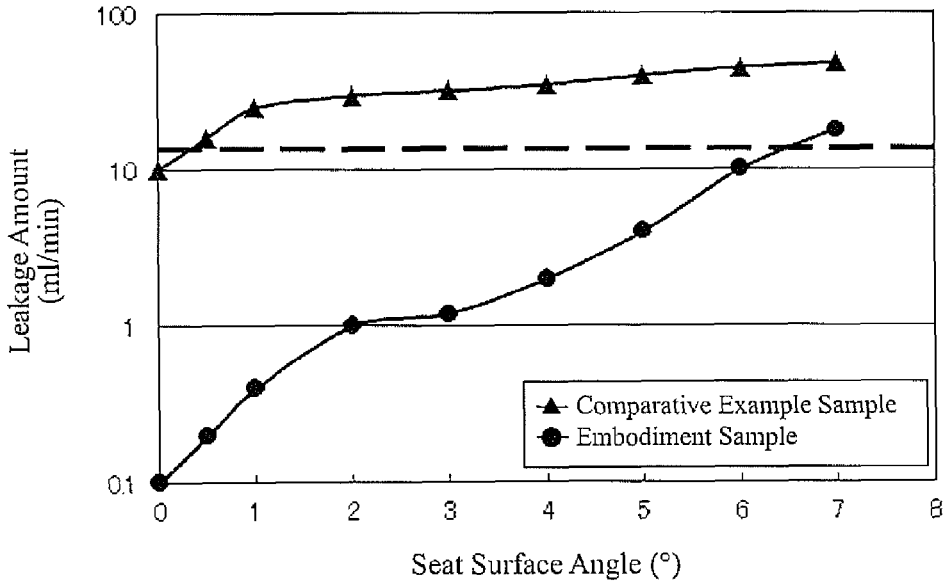
FIG. 14 is a graph showing air tightness test results of plug samples of varying seat surface angle.

Spark plug samples, ten samples for each type, were prepared by varying the seat surface angle of the metal shell. Each of the samples was subjected to air tightness test. FIG. 14 shows the air tightness test results. The procedure of the air tightness test was as follows. Each of the samples was mounted to an aluminum bushing, as a test stage simulating an engine head of an internal combustion engine, with a fastening torque of 15 N·m. The amount of air leakage per minute between the gasket and the metal shell and between the gasket and the aluminum bushing was measured by applying an air pressure of 1.5 MPa to a front end portion of the sample. It can be said that the sample had very good air tightness when the leakage amount of the sample was 15 ml/min or less.

In the respective embodiment samples, the recesses were located radially inside the innermost periphery of the outer peripheral front end surface region; and the inner peripheral front end surface region was formed in an inclined shape. Thus, the respective embodiment samples were so configured that only the outer peripheral front end surface region was held in contact with the aluminum bushing (internal combustion engine) in a state that the sample was mounted to the aluminum bushing (internal combustion engine). The respective embodiment samples were also configured to satisfy the condition of $0.2 \leq B/A \leq 0.75$.

In FIG. 14, the test results of the embodiment samples are indicated by circles; and the test results of the comparative example samples are indicated by triangles. Further, the evaluation standard level of 15 ml/min is indicated by a horizontal dashed line in FIG. 14.

As shown in FIG. 14, the leakage amount of the comparative example sample was more than the evaluation standard level of 15 ml/min when the seat surface angle was larger than or equal to 0.5°. On the other hand, the leakage amount of the embodiment sample was less than the evaluation standard level of 15 ml/min when the seat surface angle was smaller than or equal to 6°. It is apparent that the embodiment samples had good air tightness when the angle of the seat surface was in the range of 0.5° to 6°.

DESCRIPTION OF REFERENCE NUMERALS

1: Spark plug
3: Metal shell

15: Male thread portion
16: Seat portion
18: Gasket
35: Front end surface (of gasket)
36: Rear end surface (of gasket)
41: Recess
351: Inner peripheral front end surface region
351A: First inner peripheral front end surface area
351B: Second inner peripheral front end surface area
352: Outer peripheral front end surface region
361: Inner peripheral rear end surface region
362: Inner peripheral rear end surface region
CL1: Axis
CL2: Center line (of gasket)

Having described the invention, the following is claimed:

1. A spark plug comprising:

a metal shell having an axial hole formed therethrough in the direction of an axis; and a solid annular gasket fitted around an outer peripheral surface of the metal shell, the metal shell including: a male thread portion formed on a front end region of the outer peripheral surface thereof for mounting of the spark plug; and a seat portion formed in rear of the male thread portion and protruding radially outwardly, the gasket being disposed between the male thread portion and the seat portion, wherein the gasket has a recessed portion formed with a depth in the direction of the axis such that the recessed portion has an opening at a surface of the gasket located opposite to the seat portion, wherein the surface of the gasket located opposite to the seat portion includes: an inner peripheral front end surface region formed such that a distance from a reference plane, which passes through a rear end of the recessed portion and extends perpendicular to a center line of the gasket, to the inner peripheral front end surface region decreases toward an inner periphery of the gasket; and an outer peripheral front end surface region formed radially outside the inner peripheral front end surface region, wherein the opening of the recessed portion is located radially inside an innermost periphery of the outer peripheral front end surface region, and wherein the gasket satisfies a condition of L1<L2 where, in the cross section including the center line and passing through the rear end of the recessed portion, L1 is a minimum distance from the center line to a point of the gasket located in front of the reference plane and closest to the center line; and L2 is a minimum distance from the center line to a point of the gasket located in rear of the reference plane and closest to the center line.

2. The spark plug according to claim 1, wherein, in a cross section including the center line and passing through the rear end of the recessed portion, the inner peripheral front end surface region has a first inner peripheral front end surface area located radially outside the opening of the recessed portion.

3. The spark plug according to claim 1, wherein the opening of the recessed portion is formed at a circumferential part of the surface of the gasket located opposite to the seat portion.

4. The spark plug according to claim 1, wherein the gasket satisfies a condition of $0.2 \leq B/A \leq 0.75$ where A (mm) is an protrusion amount by which the seat portion protrudes radially outwardly relative to a minimum imaginary cylinder enclosing the male thread portion; and B (mm) is, in the cross section including the center line, a length of the outer peripheral front end surface region in a direction perpendicular to the center line.

5. The spark plug according to claim 1, wherein a surface of the gasket facing the seat portion includes: an inner peripheral rear end surface region at least partially located in rear of the inner peripheral front end surface region; and an outer peripheral rear end surface region at least partially located in rear of the outer peripheral front end surface region; and wherein, in the cross section, a distance L3 from the reference plane to the inner peripheral rear end surface region along the center line is smaller than a distance L4 from the reference plane to the outer peripheral rear end surface region along the center line.

6. The spark plug according to claim 1, wherein the gasket has a hardness of 100 to 200 Hv in units of Vickers hardness.

7. The spark plug according to claim 1, wherein, in a cross section including the axis of the metal shell, an acute angle between a surface of the seat portion facing the gasket and an imaginary line perpendicular to the axis of the metal shell is 0.5 to 0.6°.

* * * * *